US009609702B2

(12) United States Patent
Kim et al.

(10) Patent No.: US 9,609,702 B2
(45) Date of Patent: Mar. 28, 2017

(54) LED LIGHTING APPARATUS AND CONTROL CIRCUIT THEREOF

(71) Applicant: SILICON WORKS CO., LTD., Daejeon (KR)

(72) Inventors: Yong Goo Kim, Daejeon (KR); Won Ji Lee, Cheonahn-si (KR); Kyung Min Kim, Daejeon (KR); Jong Min Lee, Busan (KR); Young Suk Son, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 14/901,536

(22) PCT Filed: Jun. 25, 2014

(86) PCT No.: PCT/KR2014/005626
§ 371 (c)(1),
(2) Date: Dec. 28, 2015

(87) PCT Pub. No.: WO2014/209008
PCT Pub. Date: Dec. 31, 2014

(65) Prior Publication Data

US 2016/0150607 A1 May 26, 2016

(30) Foreign Application Priority Data

Jun. 28, 2013 (KR) ..... 10-2013-0075453

(51) Int. Cl.
*H05B 33/08* (2006.01)

(52) U.S. Cl.
CPC ..... *H05B 33/0815* (2013.01); *H05B 33/0824* (2013.01); *H05B 33/0851* (2013.01)

(58) Field of Classification Search
CPC ..... H05B 33/0851; H05B 33/0815; H05B 33/0824
(Continued)

(56) References Cited

U.S. PATENT DOCUMENTS

2010/0123403 A1* 5/2010 Reed ..... H05B 33/0815 315/193
2010/0213859 A1* 8/2010 Shteynberg ..... H05B 33/0815 315/224
(Continued)

FOREIGN PATENT DOCUMENTS

CN 102665324 9/2012
KR 10-2011-0051062 5/2011
(Continued)

OTHER PUBLICATIONS

International Search Report for International Application No. PCT/KR2014/005626, dated Oct. 21, 2014.
(Continued)

*Primary Examiner* — Douglas W Owens
*Assistant Examiner* — Syed M Kaiser
(74) *Attorney, Agent, or Firm* — Kile Park Reed & Houtteman PLLC

(57) ABSTRACT

Disclosed are an LED lighting apparatus and a control circuit thereof which controls the brightness of a lamp including LEDs using a dimmer. The LED lighting apparatus and the control circuit use a starting current based on a rectified voltage, in order to supply a holding current to the dimmer in a state where a lamp including LEDs is turned off.

15 Claims, 3 Drawing Sheets

(58) Field of Classification Search
USPC ..... 315/210, 294, 224, 307
See application file for complete search history.

(56) References Cited

U.S. PATENT DOCUMENTS

| | | | | |
|---|---|---|---|---|
| 2011/0121744 | A1* | 5/2011 | Salvestrini | H05B 33/0815 315/246 |
| 2011/0309759 | A1* | 12/2011 | Shteynberg | H05B 33/0815 315/201 |
| 2012/0153869 | A1* | 6/2012 | Sadwick | H05B 33/0815 315/307 |
| 2012/0286696 | A1* | 11/2012 | Ghanem | H05B 33/0815 315/291 |
| 2013/0049599 | A1* | 2/2013 | Logiudice | H05B 33/083 315/122 |
| 2013/0278145 | A1* | 10/2013 | Lin | H05B 33/0851 315/122 |
| 2013/0320880 | A1* | 12/2013 | Walker | H05B 37/02 315/294 |
| 2014/0111113 | A1* | 4/2014 | Del Carmen, Jr. | H02M 3/158 315/297 |

FOREIGN PATENT DOCUMENTS

| | | |
|---|---|---|
| KR | 10-2012-0017694 | 2/2012 |
| KR | 10-2013-0026898 | 3/2013 |
| KR | 10-2013-0041570 | 4/2013 |
| WO | 2013/008967 | 1/2013 |

OTHER PUBLICATIONS

Written Opinion for International Application No. PCT/KR2014/005626, dated Oct. 21, 2014.

* cited by examiner

LED LIGHTING APPARATUS AND CONTROL CIRCUIT THEREOF

TECHNICAL FIELD

The present disclosure relates to an LED lighting apparatus, and more particularly, to an LED lighting apparatus and a control circuit thereof, which controls illumination of a lamp including LEDs using a dimmer.

BACKGROUND ART

According to the recent trend of lighting technology, an LED has been employed as a light source, in order to reduce energy.

A high-brightness LED is differentiated from other light sources in terms of various aspects such as energy consumption, lifetime, and light quality.

However, since the LED is driven by a current, a lighting apparatus using the LED as a light source requires a large number of additional circuits for current driving.

In order to solve the above-described problem, an AC direct-type lighting apparatus has been developed.

The AC direct-type LED lighting apparatus generates a rectified voltage using a commercial AC power supply and drives an LED. Since the AC direct-type LED lighting apparatus directly uses the rectified voltage as an input voltage without using an inductor and capacitor, the AC direct-type LED lighting apparatus has a satisfactory power factor.

A general LED lighting apparatus is designed to be driven through a voltage obtained by rectifying commercial power. In general, a lamp of the LED lighting apparatus includes a large number of LEDs connected in series to each other.

Recently, the LED lighting apparatus has employed a dimmer using a triac, in order to control brightness. The dimmer is generally used to control the brightness of an incandescent lamp, and a constant value of current needs to be maintained for operation of the element.

The rectified voltage used for driving the LED lighting apparatus has a ripple which rises and falls. During a valley period of the ripple of the rectified voltage, a lamp of the LED lighting apparatus is turned off. While the lamp is turned off, no current flow is generated in the LED lighting apparatus.

Since no current flow is generated in the LED lighting apparatus in a state where the lamp is turned off, the LED lighting apparatus has difficulties in providing a holding current required for the operation of the triac.

When the LED lighting apparatus includes the dimmer implemented with a triac, the operation of the triac may not be maintained in case where the lamp is turned off due to the characteristic of the rectified voltage, which makes it difficult to perform brightness control.

DISCLOSURE

Technical Problem

Various embodiments are directed to an LED lighting apparatus and a control circuit thereof which performs a brightness control function using a dimmer.

Also, various embodiments are directed to an LED lighting apparatus and a control circuit thereof which is capable of supplying a holding current to a dimmer using a starting current based on a rectified voltage in a state where a lamp including LEDs is turned off.

Further, various embodiments are directed to an LED lighting apparatus and a control circuit thereof which is capable of supplying a holding current to a dimmer during a predetermined period in which a lamp including a plurality of LEDs is turned off, during a predetermined time after the lamp emits light, and during a predetermined time before the lamp is turned off.

Technical Solution

In an embodiment, there is provided a control circuit of an LED lighting apparatus, which receives a rectified voltage corresponding to an AC voltage passed through a dimmer and controls a plurality of LED groups included in a lamp to emit light in response to the rectified voltage. The control circuit may include: a regulation circuit configured to provide a selective current path to the plurality of LED groups which emit light in response to the rectified voltage; and a current control circuit configured to sense a current of the current path, guarantee a flow of starting current based on the rectified voltage during a time including a turn-off period of the lamp, and control supply of a holding current to the dimmer.

In another embodiment, there is provided a control circuit of an LED lighting apparatus, which receives a rectified voltage corresponding to an AC voltage passed through a dimmer and controls a plurality of LED groups included in a lamp to emit light in response to the rectified voltage. The control circuit may include: a regulation circuit configured to provide a selective current path to the LED groups which emit light in response to the rectified voltage; a first holding current control circuit configured to sense a current of the current path, guarantee a flow of starting current based on the rectified voltage in response to a point of time that the lamp is turned off, and control supply of a holding current to the dimmer; and a second holding current control circuit configured to sense the current of the current path, guarantee the flow of starting current based on the rectified voltage after a first time point before the lamp is turned off and until a second time point after the lamp emits light, and control the supply of the holding current to the dimmer.

In another embodiment, an LED lighting apparatus may include: a lamp including a plurality of LED groups; a power supply unit including a dimmer and configured to convert an AC voltage into a rectified voltage and supply the rectified voltage to the lamp; a control circuit configured to selectively provide a current path corresponding to light emitting states of the respective LED groups, form the current path by comparing a current sensing voltage corresponding to a current light emitting state to reference voltages allocated to the respective LED groups, guarantee a flow of starting current based on the rectified voltage using the current sensing voltage during a time including a turn-off period of the lamp, and control supply of a holding current to the dimmer; and a current sensing element connected to the current path and configured to provide the current sensing voltage.

Advantageous Effects

In accordance with the embodiments of the present invention, the control circuit can control the rectified voltage using the dimmer including a triac, thereby controlling the brightness of the LED lighting apparatus.

Furthermore, the control circuit can control the brightness of the LED lighting apparatus using the dimmer, and supply the holding current to the dimmer even during a period in which the lamp is turned off, thereby stably driving the LED lighting apparatus.

Furthermore, the control circuit can supply the holding current to the dimmer during a period in which the lam is turned off, during a predetermined time after the lamp emits light, and during a predetermined time before the lamp is turned off, thereby stably driving the LED lighting apparatus.

MODE FOR INVENTION

Figure 1:
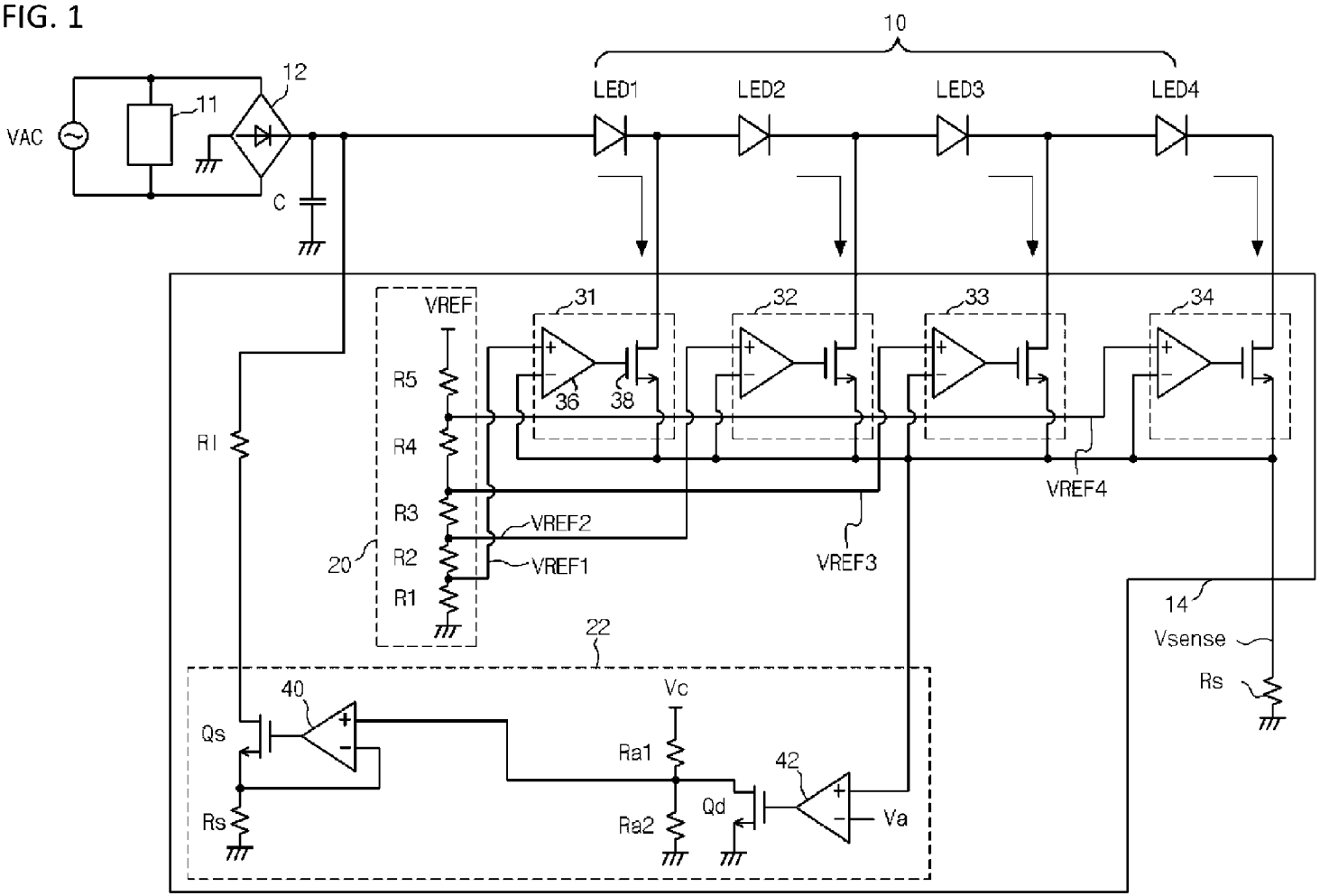
FIG. 1 is a circuit diagram illustrating an LED lighting apparatus and a control circuit thereof in accordance with an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

An LED lighting apparatus in accordance with an embodiment of the present invention includes a dimmer applied to a power supply unit in order to control the brightness of a lamp, and the dimmer may be implemented with a triac 11. In the embodiment of the present invention, the dimmer is implemented with the triac 11, but the present invention is not limited thereto. Furthermore, the LED lighting apparatus in accordance with the embodiment of the present invention provides a holding current for operation of the triac 11.

The LED lighting apparatus in accordance with the embodiment of FIG. 1 includes a lamp 10 including LEDs, a power supply unit including a triac 11, and a control circuit 14 having a current regulation function for light emission of the lamp 10 and a function of providing a holding current to the triac 11.

The control circuit 14 includes a regulation circuit and a holding current control circuit 22. The regulation circuit provides a selective current path corresponding to a light emitting state to LED groups of the lamp 10 through the current regulation function, and the holding current control circuit 22 provides a holding current for the operation of the triac 11 using a starting current supplied to the lamp 10 for a predetermined time, at the initial point of time that a rectified voltage is applied.

The regulation circuit includes a plurality of switching circuits 31 to 34 and a reference voltage supply unit 20 for providing reference voltages VREF1 to VREF4.

The LED lighting apparatus in accordance with the embodiment of FIG. 1 will be described in more detail.

Figure 3:
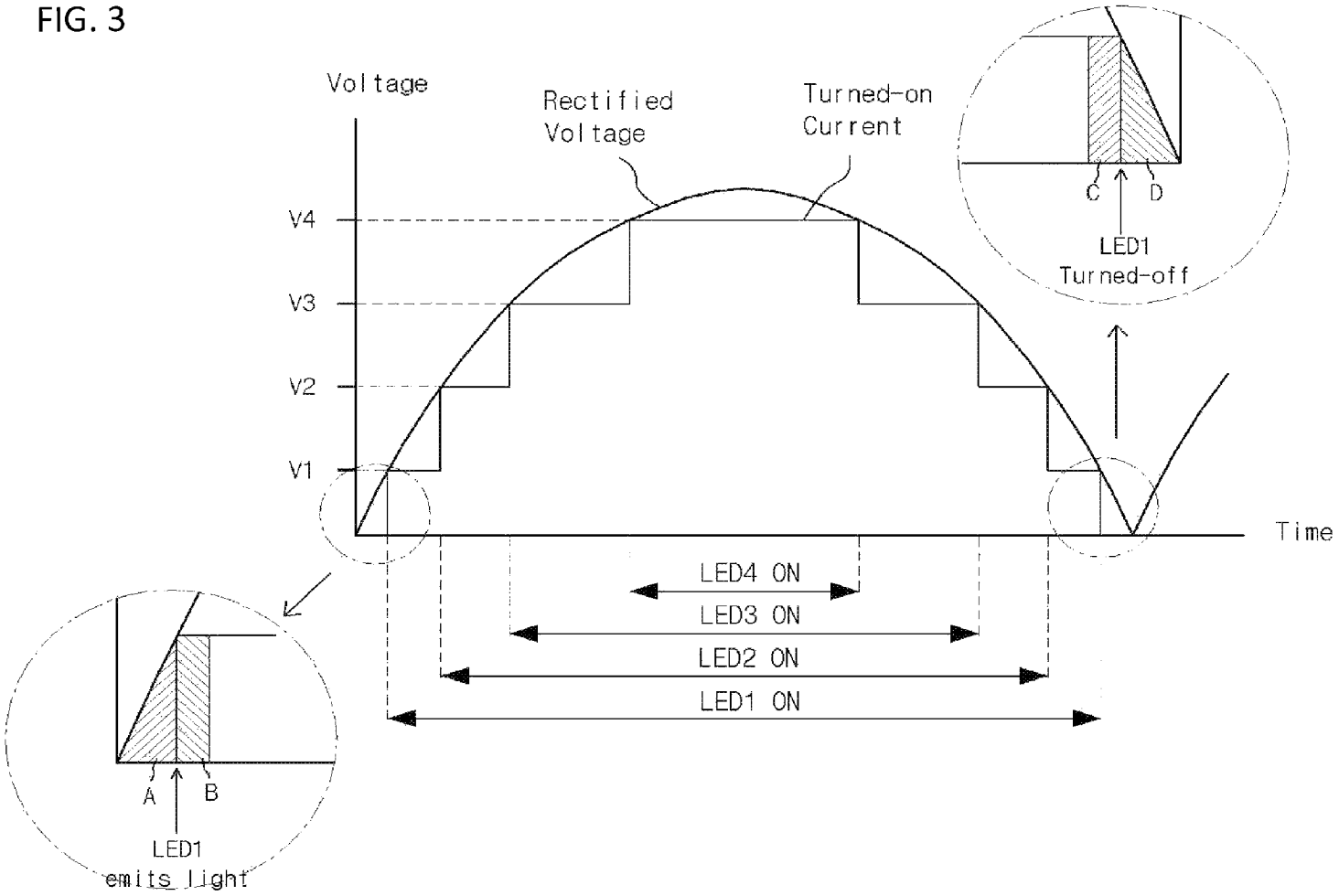
FIG. 3 is a waveform diagram for describing the operations of the embodiments of FIGS. 1 and 2.

The lamp 10 includes a plurality of LED groups LED1 to LED4. The LED groups LED1 to LED4 of the lamp 10 are sequentially turned on or off according to a ripple of a rectified voltage supplied from the power supply unit as illustrated in FIG. 3.

FIG. 1 illustrates that the lamp 10 includes four LED groups LED1 to LED4. For convenience of description, each of the LED groups LED1 to LED4 is represented by one symbol. However, each of the LED groups LED1 to LED4 may include a plurality of LEDs connected in series, in parallel, or in serial-parallel to each other. Furthermore, FIG. 1 illustrates that the lamp 10 includes four LED groups connected in series. However, the present invention is not limited thereto, but various numbers of stages may be connected in series.

The power supply unit is configured to rectify an AC voltage and output the rectified voltage. For this operation, the power supply unit may include an AC power supply VAC for supplying an AC voltage, the triac 11, a rectifier circuit 12 for outputting a rectified voltage, and a capacitor C for smoothing the rectified voltage outputted from the rectifier circuit 12. The AC power supply VAC may include a commercial power supply.

The triac 11 has a dimming function of controlling the brightness of the lamp 10. The triac 11 may control the phase of the AC voltage transmitted to the rectifier circuit 12 according to control of a user using a control unit (not illustrated) which is separately included in the dimmer. The brightness of the lamp 10 may be adjusted through the phase control of the AC voltage by the triac 11.

The phase control by the triac 11 may be achieved by controlling conduction timing based on the position at which the zero potential of the sine-wave AC voltage is detected (zero potential detection position). The triac 11 may output an AC voltage to have a phase controlled according to the conduction timing. The rectifier circuit 12 full-wave rectifies the AC voltage of the AC power supply VAC, of which the phase is controlled by the triac 11, and outputs the rectified voltage. Thus, the rectified voltage has a ripple in which the voltage level changes on a basis of the half cycle of the AC voltage, as illustrated in FIG. 3.

The control circuit 14 performs current regulation for light emissions of the LED groups LED1 to LED4, and provides a current path through a current sensing resistor Rs of which one end is grounded.

In the above-described configuration, the LED groups LED1 to LED4 of the lamp 10 are sequentially turned on or off in response to rises or falls of the rectified voltage. When the rectified voltage rises or falls to sequentially reach the light emission voltages of the respective LED groups LED1 to LED4, the control circuit 14 selectively provides a current path for light emission of the respective LED groups LED1 to LED4.

The light emission voltage V4 is defined as a voltage for controlling all of the LED groups LED1 to LED4 to emit light, the light emission voltage V3 is defined as a voltage for controlling the LED groups LED1 to LED3 to emit light, the light emission voltage V2 is defined as a voltage for controlling the LED groups LED1 and LED2 to emit light, and the light emission voltage V1 is defined as a voltage for controlling only the LED group LED1 to emit light.

The control circuit 14 may receive a current sensing voltage Vsense through the current sensing resistor Rs, and the current sensing voltage Vsense may be varied by a current amount which is changed according to the light emitting state of the lamp 10. At this time, the current flowing through the current sensing resistor Rs may include a constant current.

The control circuit 14 includes a plurality of switching circuits 31 to 34 and a reference voltage supply unit 20. The plurality of switching circuits 31 to 34 provide a current path for the LED groups LED1 to LED4, and the reference voltage supply unit 20 provides reference voltages VREF1 to VREF4.

The reference voltage supply unit 20 includes a plurality of resistors R1 to R5 which are connected in series to receive a constant voltage VREF.

The resistor R1 is connected to a ground, and the resistor R5 receives the constant voltage VREF and serve as a load resistor for adjusting an output. The resistors R1 to R4 serve to output the reference voltages VREF1 to VREF4 having different levels. Among the reference voltages VREF1 to VREF4, the reference voltage VREF1 has the lowest voltage level, and the reference voltage VREF4 has the highest voltage level.

The resistors R1 to R4 may have resistance values which are set to output four reference voltages VREF1 to VREF4 of which the levels gradually rise in response to variations of the rectified voltage applied to the LED groups LED1 to LDE4.

The reference voltage VREF1 has a level for turning off the switching circuit 31 at the point of time that the LED group LED2 emits light. More specifically, the reference voltage VREF1 may be set to a level equal to or lower than the current sensing voltage Vsense which is formed in the current sensing resistor Rs by the light emission voltage V2.

The reference voltage VREF2 may have a level for turning off the switching circuit 32 at the point of time that the LED group LED3 emits light. More specifically, the reference voltage VREF2 may be set to a level equal to or lower than the current sensing voltage Vsense which is formed in the current sensing resistor Rs by the light emission voltage V3.

The reference voltage VREF3 may have a level for turning off the switching circuit 33 at the point of time that the LED group LED4 emits light. More specifically, the reference voltage VREF3 may be set to a level equal to or lower than the current sensing voltage Vsense which is formed in the current sensing resistor Rs by the light emission voltage V4.

The reference voltage VREF4 may be set to a higher level than the current sensing voltage which is formed in the current sensing resistor Rs by the upper limit level of the rectified voltage.

The switching circuits 31 to 34 are commonly connected to the current sensing resistor Rs for providing the current sensing voltage Vsense.

The switching circuits 31 to 34 are turned on or off according to the comparison results between the current sensing voltage Vsense of the current sensing resistor Rs and the reference voltages VREF1 to VREF4 of the reference voltage supply unit 20, and provide a selective current path corresponding to the light emitting state of the lamp 10.

Each of the switching circuits 31 to 34 receives a high-level reference voltage as the switching circuit is connected to an LED group remote from the position to which the rectified voltage is applied.

Each of the switching circuits 31 to 34 may include a comparator 36 and a switching element, and the switching element may include an NMOS transistor 38.

The comparator 36 included in each of the switching circuits 31 to 34 receives the reference voltage through a positive input terminal (+) thereof, receives the current sensing voltage Vsense through a negative input terminal (−) thereof, and outputs a comparison result between the reference voltage and the current sensing voltage Vsense through an output terminal.

According to the above-described configuration, the LED lighting apparatus in accordance with the embodiment of FIG. 1 performs a current regulation operation for light emission of the lamp. The current regulation operation of the embodiment of FIG. 1 will be described with reference to FIG. 3.

When the rectified voltage is in the initial state, the plurality of LED groups LED1 to LED4 of the lamp 10 does not emit light. Thus, the current sensing resistor Rs provides the current sensing voltage Vsense at a low level.

In this case, all of the switching circuits 31 to 34 maintain a turn-on state, because the reference voltages VREF1 to VREF4 applied to the positive input terminals (+) thereof are higher than the current sensing voltage Vsense applied to the negative input terminals (−) thereof.

Then, when the rectified voltage rises to reach the light emission voltage V1, the LED group LED1 of the lamp 10 emits light. When the LED group LED1 of the lamp 10 emits light, the switching circuit 31 of the control circuit 14, connected to the LED group LED1, provides a current path.

When the LED group LED1 emits light, the current path is formed through the switching circuit 31, and the level of the current sensing voltage Vsense of the current sensing resistor Rs rises. At this time, however, since the level of the current sensing voltage Vsense is low, the turn-on states of the switching circuits 31 to 34 are not changed.

Then, when the rectified voltage continuously rises to reach the light emission voltage V2, the LED group LED2 of the lamp 10 emits light. When the LED group LED2 of the lamp 10 emits light, the switching circuit 32 of the control circuit 14, connected to the LED group LED2, provides a current path. At this time, the LED group LED1 also maintains the light emitting state.

When the LED group LED2 emits light, the current path is formed through the switching circuit 32, and the level of the current sensing voltage Vsense of the current sensing resistor Rs rises. At this time, the current sensing voltage Vsense has a higher level than the reference voltage VREF1. Therefore, the NMOS transistor 38 of the switching circuit 31 is turned off by an output of the comparator 36. That is, the switching circuit 31 is turned off, and the switching circuit 32 provides the current path corresponding to the light emission of the LED group LED2.

Then, when the rectified voltage continuously rises to reach the light emission voltage V3, the LED group LED3 of the lamp 10 emits light. When the LED group LED3 of the lamp 10 emits light, the switching circuit 33 of the control circuit 14, connected to the LED group LED3, provides a current path. At this time, the LED groups LED1 and LED2 also maintain the light emitting state.

When the rectified voltage reaches the light emission voltage V3 such that the LED group LED3 emits light, the current path is formed through the switching circuit 33, and the level of the current sensing voltage Vsense of the current sensing resistor Rs rises. At this time, the current sensing voltage Vsense has a higher level than the reference voltage VREF2. Therefore, the NMOS transistor 38 of the switching circuit 32 is turned off by an output of the comparator 36. That is, the switching circuit 32 is turned off, and the switching circuit 33 provides the current path corresponding to the light emission of the LED group LED3.

Then, when the rectified voltage continuously rises to reach the light emission voltage V4, the LED group LED4 of the lamp 10 emits light. When the LED group LED4 of the lamp 10 emits light, the switching circuit 34 of the control circuit 14, connected to the LED group LED4, provides a current path. At this time, the LED groups LED1 to LED3 also maintain the light emitting state.

When the rectified voltage reaches the light emission voltage V4 such that the LED group LED4 emits light, the current path is formed through the switching circuit 34, and the level of the current sensing voltage Vsense of the current sensing resistor Rs rises. At this time, the current sensing voltage Vsense has a higher level than the reference voltage VREF3. Therefore, the NMOS transistor 38 of the switching circuit 33 is turned off by an output of the comparator 36.

That is, the switching circuit 33 is turned off, and the switching circuit 34 provides the current path corresponding to the light emission of the LED group LED4.

Then, although the rectified voltage continuously rises, the switching circuit 34 maintains the turn-on state, because the reference voltage VREF4 supplied to the switching circuit 34 has a higher level than the current sensing voltage Vsense formed in the current sensing resistor Rs by the upper limit level of the rectified voltage.

The rectified voltage starts to falls after the upper limit level.

When the rectified voltage falls below the light emission voltage V4, the LED group LED4 of the lamp 10 is turned off.

When the LED group LED4 of the lamp 10 is turned off, the LED groups LED3, LED2, and LED1 maintain light emission, and the control circuit 14 provides a current path through the switching circuit 33 in response to the light emitting state of the LED group LED3.

Then, when the rectified voltage sequentially falls below the light emission voltages V3, V2, and V1, the LED groups LED3, LED2, and LED1 of the lamp 10 are sequentially turned off.

As the LED groups LED3, LED2, and LED1 of the lamp 10 are sequentially turned off, the control circuit 14 shifts and provides the current path in order of the switching circuits 33, 32, and 31.

As described above, the LED groups LED1 to LED4 of the lamp 10 may sequentially emit light according to the changes of the rectified voltage, and the control circuit 14 may selectively provide a current path for light emission through current regulation.

The control circuit 14 in accordance with the embodiment of FIG. 1 includes the holding current control circuit 22 for controlling the supply of a holding current for the operation of the triac 11.

The holding current control circuit 22 controls the supply of a holding current to the triac 11 until the lamp 10 emits light after the lamp 10 is turned off, that is, while the lamp 10 maintains the turn-off state. The holding current may be supplied to the triac 11 through a starting current based on the rectified voltage applied to the lamp 10.

The holding current control circuit 22 senses the current amount of the current path formed by the switching circuits 31 to 34, in order to control the time during which the holding current is supplied. That is, the holding current control circuit 22 controls the time during which the holding current is supplied, using the current sensing voltage Vsense applied to the current sensing resistor Rs.

The holding current control circuit 22 includes a comparator 42, a switching signal output circuit, and a current supply circuit. The comparator 42 compares the current sensing voltage based on the current amount of the current path to a comparison voltage having a preset level. The switching signal output circuit outputs a switching signal as a first voltage (high level) or second voltage (low level) according to an output state of the comparator 42. The current supply circuit guarantees a flow of starting current based on the rectified voltage according to the switching signal, and controls the supply of the holding current to the triac 11.

The comparator 42 receives the current sensing voltage Vsense through a positive terminal (+) thereof, receives a preset comparison voltage Va through a negative terminal (−) thereof, and outputs a signal corresponding to a difference between the current sensing voltage Vsense and the comparison voltage Va.

At this time, the comparison voltage Va may be set to a level corresponding to the current amount of the current path formed by the switching circuit 31 or the current sensing voltage Vsense applied to the current sensing resistor Rs, at the point of time that the lamp 10 emits light.

Thus, the comparator 42 outputs a high-level signal when the LED group LED1 of the lamp 10 emits light, and outputs a low-level signal when the LED group LED1 is turned off.

The switching signal output circuit may include an NMOS transistor Qd and an output circuit. The NMOS transistor Qd serves as a first switching element which is switched according to the output state of the comparator 42, and the output circuit outputs the switching signal as the first voltage (high level) or the second voltage (low level) according to the on/off state of the NMOS transistor Qd.

The NMOS transistor Qd is switched by the output of the comparator 42. That is, the NMOS transistor Qd is turned on by the high-level signal outputted from the comparator 42, when the LED group LED1 of the lamp 10 emits light. Furthermore, the NMOS transistor Qd is turned off by the low-level signal outputted from the comparator 42, when the LED group LED1 of the lamp 10 is turned off.

The output circuit includes resistors Ra1 and Ra2 connected in series. The resistor Ra1 receives a constant voltage Vc, and the resistor Ra2 receives a ground voltage. The potential of the node between the resistors Ra1 and Ra2 is changed to a high or low level by a switching operation of the NMOS transistor Qd.

That is, when the NMOS transistor Qd is turned off by the output of the comparator 42 corresponding to the turn-off state of the lamp 10, a high-level voltage is applied to the node between the resistors Ra1 and Ra2. Thus, the switching signal is set to a high level.

On the other hand, when the NMOS transistor Qd is turned on by the output of the comparator 42 corresponding to the light emitting state of the lamp 10, a low-level voltage is applied to the node between the resistors Ra1 and Ra2. Thus, the switching signal is set to a low level.

The current supply circuit includes a buffer 40 and an NMOS transistor Qs.

The buffer 40 includes a comparator, and has a negative terminal (−) connected to the drain of the NMOS transistor Qs and a positive terminal (+) configured to receive the switching signal driven to the node between the resistors Ra1 and Ra2 connected in series.

The buffer 40 having the above-described configuration receives the switching signal through the positive terminal (+) and transmits the received signal to the gate of the NMOS transistor Qs.

The NMOS transistor Qs may be defined as a second switching element, and selectively switch a flow of starting current according to the output of the buffer 40.

The NMOS transistor Qs has a source connected to a resistor RI to which the starting current is introduced and a drain connected to a grounded resistor Rs. The NMOS transistor Qs is connected in parallel to a capacitor C through the resistor RI, the capacitor C smoothing the rectified voltage outputted from the rectifier circuit 12 of the power supply unit.

In the above-described configuration, while the lamp 10 is turned off (A or D of FIG. 3), the NMOS transistor Qs maintains the turn-on state according to the switching signal provided at a high level, and the starting current introduced through the resistor RI flows to the path passing through the NMOS transistor Qs and the resistor Rs.

According to the above-described configuration, the NMOS transistor Qs may provide the path guaranteeing a flow of starting current to the triac 11 and the rectifier circuit 12, and the triac 11 may receive a holding current through the flow of starting current.

When the LED group LED1 of the lamp 10 is switched to the light emitting state (B of FIG. 3), the NMOS transistor Qs is turned off by the switching signal provided at a low level, and the flow of starting current introduced through the resistor RI is blocked. When the LED group LED1 of the lamp 10 emits light, a current flow is guaranteed by the current path formed in the switching circuit 31. Thus, the triac 11 can receive a holding current required for operation.

That is, since the triac 11 can receive the holding current in a state where the lamp 10 is turned off as well as in a state where the lamp 10 is turned on, the triac 11 can be stably operated.

Thus, in accordance with the embodiment of the present invention, the LED lighting apparatus using the triac 11 can be implemented.

Figure 2:
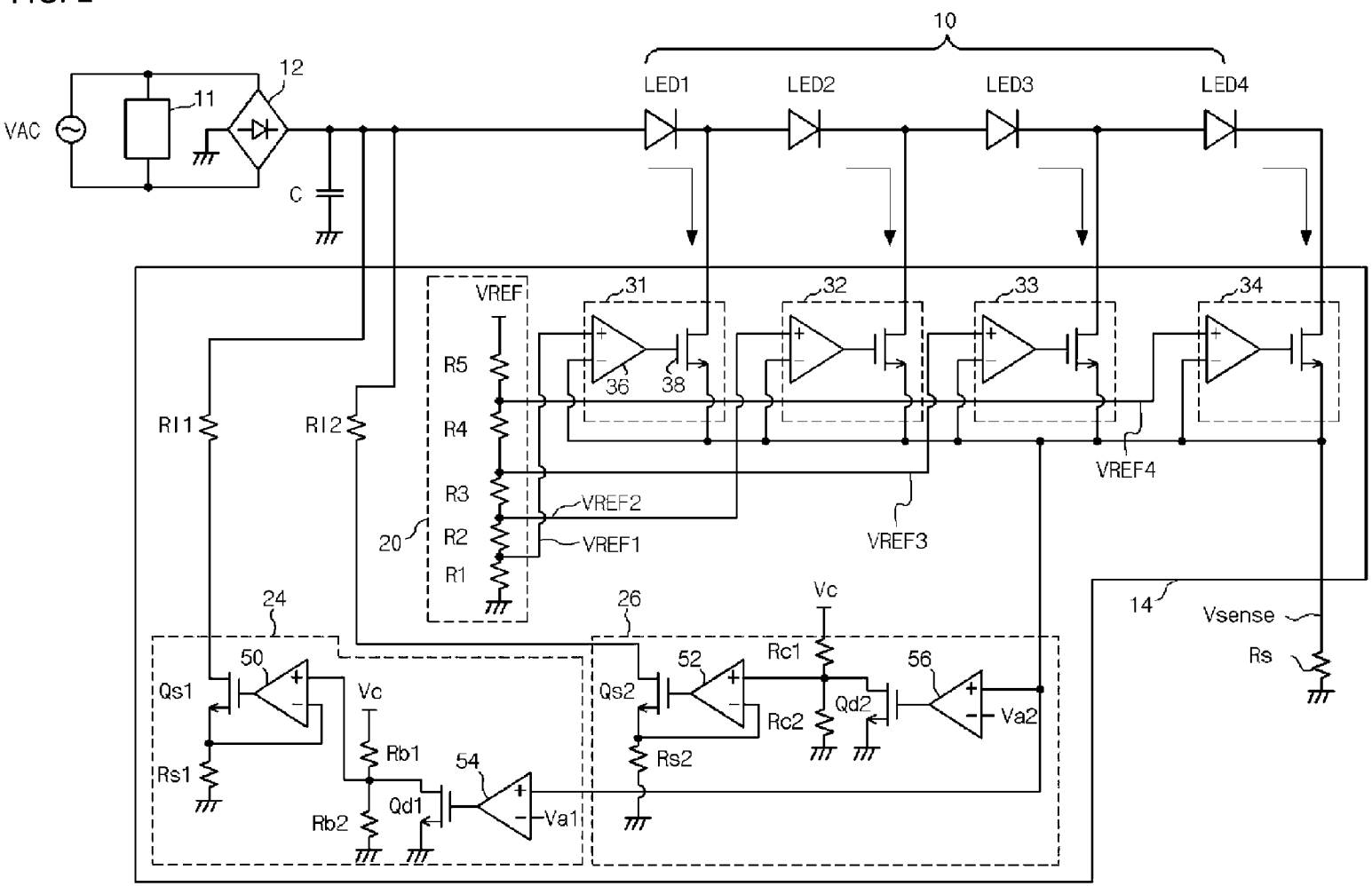
FIG. 2 is a circuit diagram illustrating an LED lighting apparatus and a control circuit thereof in accordance with another embodiment of the present invention.

In the embodiment of the present invention, the supply of the holding current for the operation of the triac 11 may be controlled as illustrated in FIG. 2.

In the embodiment of FIG. 2, the same parts as those of FIG. 1 are represented by like reference numerals, and the duplicated descriptions thereof are omitted herein.

FIG. 2 illustrates a configuration in which the control circuit 14 includes first and second holding current control circuits 24 and 26.

The first holding current control circuit 24 is configured to guarantee a flow of starting current supplied to the lamp 10 and control the supply of a holding current for operation of the triac 11 at the initial point of time (A of FIG. 3) that the lamp 10 is turned off or the point of time (B of FIG. 3) that the level of the rectified voltage falls to turn off the lamp 10.

The second holding current control circuit 26 is configured to guarantee a flow of starting current supplied to the lamp 10 and control the supply of a holding current for operation of the triac 11 before (C of FIG. 3) or after (B of FIG. 3) the holding current is supplied by the first holding current control circuit 24.

The points of time that the first and second holding current control circuits 24 and 26 supply the holding current may be controlled by adjusting the levels of comparison voltages Va1 and Va2 which are compared to the current amount of the current path formed by the switching circuits 31 to 34, that is, the current sensing voltage Vsense.

In the embodiment of FIG. 2, the first and second holding current control circuits 24 and 26 have substantially the same configuration as the holding current control circuit 22 of FIG. 1, except that the comparison voltages Va1 and Va2 applied to the respective comparators 54 and 56 are different from the comparison voltage Va of FIG. 1. Thus, the duplicated descriptions thereof are omitted herein. However, the parts of the first and second holding current control circuits 24 and 26 are represented by different reference numerals from those of the holding current control circuit 22, in order to distinguish between the first and second holding current control circuits 24 and 26 and the holding current control circuit 22.

The comparison voltage Va1 may be set to a level corresponding to the current amount of the current path at the point of time that the lamp 10 emits light, and the comparison voltage Va2 may be set to a higher level than the comparison voltage Va1.

In the embodiment of FIG. 2, the first holding current control circuit 24 senses the current of the current path formed by the switching circuits 31 to 34, and thus senses the turn-off period of the lamp 10 (A or D of FIG. 3). Furthermore, the first holding current control circuit 24 guarantees a flow of starting current based on the rectified voltage in response to the turn-off period of the lamp 10, and controls the supply of the holding current to the triac 11.

The second holding current control circuit 26 senses the current of the current path formed by the switching circuits 31 to 34, and thus senses a first period (C of FIG. 3) before the lamp 10 is turned off or a second period (B of FIG. 3) after the lamp 10 emits light. Furthermore, the second holding current control circuit 26 guarantees a flow of starting current based on the rectified voltage in response to the sensed period, and controls the supply of the holding current to the triac 11.

The operation of the embodiment of FIG. 2 will be described in more detail.

The rectified voltage outputted from the rectifier circuit 12 has a ripple which rises from the zero potential detection position and falls to the zero potential detection position after reaching the upper limit level.

The current sensing voltage Vsense formed in the current sensing resistor Rs is provided to the comparators 54 and 56 in response to the state in which the lamp 10 is turned off. After the lamp 10 is turned on, the current sensing voltage Vsense is provided to the comparators 54 and 56, while having a level which rises according to sequential emissions of the LED groups LED1 to LED4.

Thus, while the lamp 10 is turned off, the comparators 54 and 56 have a low-level output in response to the low-level current sensing voltage Vsense. The NMOS transistors Qd1 and Qd2 are turned off in response to the low-level outputs of the comparators 54 and 56. The switching signals applied to the node between resistors Rb1 and Rb2 connected in series and the node between resistors Rc1 and Rc2 connected in series maintain a high level in response to the turn-off of the NMOS transistors Qd1 and Qd2.

Thus, in response to the turn-off of the lamp 10, the high-level switching signal is transmitted to the gates of the NMOS transistors Qs1 and Qs2 through the buffers 50 and 52, and the NMOS transistors Qs1 and Qs1 are turned on.

As described above, the NMOS transistors Qs1 and Qs2 of the first and second holding current control circuits 24 and 26 are turned on in response to the turn-off state of the lamp 10. Thus, a flow of starting current is guaranteed through the NMOS transistors Qs1 and Qs2. As a result, the triac 11 can receive a holding current for operation as indicated by A of FIG. 3.

Then, when the rectified voltage rises, the LED group LED1 of the lamp 10 emits light before the other LED groups LED2 to LED4. In response to the light emission of the LED group LED1 of the lamp 10, the switching circuit 31 provides a current path.

When the current path is formed by the switching circuit 31, a current sensing voltage Vsense applied to the current sensing resistor Rs rises.

The current sensing voltage Vsense applied to the current sensing resistor Rs at the point of time that the lamp 10 emits light is higher than the comparison voltage Va1 applied to the comparator 54 and lower than the comparison voltage Va2 applied to the comparator 56.

Thus, in response to the light emission of the lamp 10, a low-level switching signal is transmitted to the buffer 50 of the first holding current control circuit 24. As a result, the NMOS transistor Qs1 is turned off to block the flow of start current. That is, the supply of the holding current for the triac 11 by the first holding current control circuit 24 is stopped.

On the other hand, although the lamp 10 emits light, the second holding current control circuit 26 maintains the turn-on state of the NMOS transistor Qs2, because the current sensing voltage Vsense applied to the current sensing resistor Rs is lower than the comparison voltage Va2 applied to the comparator 56. That is, as indicated by B of FIG. 3, the holding current for the triac 11 may be continuously supplied by the second holding current control circuit 26.

The supply of the holding current by the second holding current control circuit 26 is maintained until the current sensing voltage Vsense applied to the current sensing resistor Rs becomes higher than the comparison voltage Va2 applied to the comparator 56 after the LED group LED1 of the lamp 10 emits light.

The comparison voltage Va2 may be set to a specific level applied to the current sensing resistor Rs between the point of time that the LED group LED1 emits light and the point of time that the LED group LED2 emits light, by a designer.

Thus, when the current sensing voltage Vsense applied to the current sensing resistor Rs becomes higher than the comparison voltage Va2 applied to the comparator 56 after the LED group LED1 of the lamp 10 emits light, the second holding current control circuit 26 blocks the starting current flow in response to the turn-off of the NMOS transistor Qs2. That is, the supply of the holding current for the triac 11 by the first and second holding current control circuits 26 is stopped.

After the supply of the holding current by the first and second holding current control circuits 26 is stopped, the triac 11 may receive the holding current through the current flow on the current path formed by the control circuit 14.

Then, when the rectified voltage falls, the LED groups LED1 to LED4 of the lamp 10 are sequentially turned off. At this time, the first and second holding current control circuits 24 and 26 do not supply a holding current.

Furthermore, when the current sensing voltage Vsense applied to the current sensing resistor Rs becomes lower than the comparison voltage Va2 applied to the comparator 56 of the second holding current control circuit 26 before the LED group LED1 of the lamp 10 is turned off, the second holding current control circuit 26 guarantees the flow of starting current in response to the turn-on of the NMOS transistor Qs2. That is, the holding current for the triac 11 by the second holding current control circuit 26 may be supplied as indicated by C of FIG. 3.

Furthermore, when the rectified voltage continuously falls, all of the LED groups LED1 to LED4 are turned off.

At this time, the current sensing voltage Vsense applied to the current sensing resistor Rs is lower than the comparison voltages Va1 and Va2 applied to the comparators 54 and 56 of the first and second holding current control circuits 24 and 26.

Then, the first and second holding current control circuits 24 and 26 guarantee the flow of starting current in response to the turn-on of the NMOS transistors Qs1 and Qs2. That is, the holding current for the triac 11 by the first and second holding current control circuits 24 and 26 may be supplied as indicated by D of FIG. 3.

As the embodiment of FIG. 2 is operated in the above-described manner, the holding current may be supplied by the starting current in a state where the lamp 10 is turned off.

The current path by the control circuit 14 may be unstably formed at the point of time that the lamp 10 is turned on or off. Thus, the holding current for the triac 11 may be unstably supplied due to the unstable current path of the control circuit 14 at the point of time that the lamp 10 is turned on or off.

However, the embodiment of FIG. 2 may guarantee the flow of starting current until a predetermined time point after the lamp 10 emits light or from a predetermined point of time before the lamp 10 is turned off. Thus, since the triac 11 can continuously receive the holding current, the triac 11 can be stably operated at all times.

The embodiments of FIGS. 1 and 2 can guarantee a stable operation of the triac 11 forming the dimmer, thereby securing the reliability of the LED lighting apparatus.

While various embodiments have been described above, it will be understood to those skilled in the art that the embodiments described are by way of example only. Accordingly, the disclosure described herein should not be limited based on the described embodiments.

The invention claimed is:

1. A control circuit of an LED lighting apparatus, which receives a rectified voltage corresponding to an AC voltage passed through a dimmer and controls a plurality of LED groups included in a lamp to emit light in response to the rectified voltage, the control circuit comprising:

a regulation circuit configured to provide a selective current path to the plurality of LED groups which emit light in response to the rectified voltage; and a current control circuit configured to sense a current of the current path, control a flow of starting current based on the rectified voltage during a time including a turn-off period of the lamp, and control supply of a holding current to the dimmer.

2. The control circuit of claim 1, wherein the regulation circuit comprises a current sensing resistor configured to provide a ground for the current path, and the holding current control circuit selects the current path using a current sensing voltage applied to the current sensing resistor.

3. The control circuit of claim 1, wherein the holding current control circuit controls the starting current based on the rectified voltage until the lamp emits light after the lamp is turned off, and supplies the holding current for operation of the dimmer.

4. The control circuit of claim 1, wherein the holding current control circuit comprises:

a comparator configured to compare a voltage corresponding to the current amount of the current path to a first comparison voltage;

a switching signal output circuit configured to output a switching signal as a first or second voltage according to an output state of the comparator; and a current supply circuit configured to switch the flow of starting current based on the rectified voltage in response to the switching signal, and supply the holding current to the dimmer.

5. The control circuit of claim 4, wherein the switching signal output circuit comprises:

a first switching element configured to be switched according to the output state of the comparator; and an output circuit configured to output the switching signal as the first or second voltage according to the on/off state of the first switching element.

6. The control circuit of claim 4, wherein the current supply circuit comprises:

a buffer configured to receive the switching signal; and a second switching element configured to selectively switch the flow of starting current based on the rectified voltage in response to an output of the buffer, and control the supply of the holding current.

7. A control circuit of an LED lighting apparatus, which receives a rectified voltage corresponding to an AC voltage passed through a dimmer and controls a plurality of LED groups included in a lamp to emit light in response to the rectified voltage, the control circuit comprising:

a regulation circuit configured to provide a selective current path to the LED groups which emit light in response to the rectified voltage;

a first holding current control circuit configured to sense a current of the current path, control a flow of starting current based on the rectified voltage in response to a point of time that the lamp is turned off, and control supply of a holding current to the dimmer; and a second holding current control circuit configured to sense the current of the current path, control the flow of starting current based on the rectified voltage after a first time point before the lamp is turned off and until a second time point after the lamp emits light, and control the supply of the holding current to the dimmer.

8. The control circuit of claim 7, wherein the regulation circuit comprises a current sensing resistor configured to provide a ground for the current path, and the first and second holding current circuits sense the current of the current path, using a current sensing voltage applied to the current sensing resistor.

9. The control circuit of claim 7, wherein each of the first and second holding current control circuits comprises:

a comparator configured to output a signal based on a voltage corresponding to the current amount of the current path;

a switching signal output circuit configured to output a switching signal as a first or second voltage according to the output state of the comparator; and a current supply circuit configured to control the flow of starting current based on the rectified voltage according to the switching signal, and supply the holding current to the dimmer, and the comparators of the first and second holding current control circuits compare the voltage corresponding to the current amount of the current path to first and second comparison voltages having different levels.

10. The control circuit of claim 9, wherein the first comparison voltage has a level corresponding to the current amount of the current path at a point of time that the lamp emits light, and the second comparison voltage has a higher level than the first comparison voltage.

11. The control circuit of claim 9, wherein the switching signal output circuit comprises:

a first switching element configured to be switched according to the output state of the comparator; and an output circuit configured to output the switching signal as the first or second voltage according to the on/off state of the first switching state.

12. The control circuit of claim 9, wherein the current supply circuit comprises:

a buffer configured to receive the switching signal; and a second switching element configured to selectively switch the flow of starting current based on the rectified voltage according to an output of the buffer, and control the supply of the holding current.

13. An LED lighting apparatus comprising:

a lamp comprising a plurality of LED groups;

a power supply unit comprising a dimmer and configured to convert an AC voltage into a rectified voltage and supply the rectified voltage to the lamp;

a control circuit configured to selectively provide a current path corresponding to light emitting states of the respective LED groups, form the current path by comparing a current sensing voltage corresponding to a current light emitting state to reference voltages allocated to the respective LED groups, control a flow of starting current based on the rectified voltage using the current sensing voltage during a time including a turn-off period of the lamp, and control supply of a holding current to the dimmer; and a current sensing element connected to the current path and configured to provide the current sensing voltage.

14. The LED lighting apparatus of claim 13, wherein the control circuit controls the flow of starting current based on the rectified voltage until the lamp emits light after the lamp is turned off.

15. The LED lighting apparatus of claim 13, wherein the control circuit controls the flow of starting current based on the rectified voltage after a first time point before the lamp is turned off and until a second time point after the lamp emits light.

* * * * *